US010374287B2

(12) United States Patent
Wu et al.

(10) Patent No.: US 10,374,287 B2
(45) Date of Patent: Aug. 6, 2019

(54) ANTENNA SYSTEM WITH FULL METAL BACK COVER

(71) Applicants: Jing Wu, Shenzhen (CN); Jianchun Mai, Shenzhen (CN); Chao Wang, Shenzhen (CN)

(72) Inventors: Jing Wu, Shenzhen (CN); Jianchun Mai, Shenzhen (CN); Chao Wang, Shenzhen (CN)

(73) Assignee: AAC TECHNOLOGIES PTE. LTD., Singapore (SG)

( * ) Notice: Subject to any disclaimer, the term of this patent is extended or adjusted under 35 U.S.C. 154(b) by 34 days.

(21) Appl. No.: 15/283,530

(22) Filed: Oct. 3, 2016

(65) Prior Publication Data

US 2017/0117614 A1 Apr. 27, 2017

(30) Foreign Application Priority Data

Oct. 26, 2015 (CN) ..... 2015 1 0700646
May 15, 2016 (JP) ..... 2016-119329

(51) Int. Cl.

| | |
|---|---|
| ***H01Q 1/24*** | (2006.01) |
| ***H01Q 1/22*** | (2006.01) |
| ***H01Q 1/48*** | (2006.01) |
| ***H01Q 9/42*** | (2006.01) |
| ***H01Q 21/30*** | (2006.01) |
| ***H01Q 1/36*** | (2006.01) |
| ***H01Q 1/38*** | (2006.01) |

(52) U.S. Cl.

CPC ..... *H01Q 1/243* (2013.01); *H01Q 1/2291* (2013.01); *H01Q 1/36* (2013.01); *H01Q 1/38* (2013.01); *H01Q 1/48* (2013.01); *H01Q 9/42* (2013.01); *H01Q 21/30* (2013.01)

(58) Field of Classification Search

CPC ..... H01Q 1/243; H01Q 1/38; H01Q 1/2291; H01Q 13/10; H01Q 9/42; H01Q 21/30

See application file for complete search history.

(56) References Cited

U.S. PATENT DOCUMENTS

| | | | | |
|---|---|---|---|---|
| 2012/0112969 | A1* | 5/2012 | Caballero | H01Q 1/243 343/702 |
| 2013/0154886 | A1* | 6/2013 | Isohatala | H01Q 1/243 343/702 |
| 2014/0078008 | A1* | 3/2014 | Kang | H01Q 5/35 343/702 |

* cited by examiner

*Primary Examiner* — Ricardo I Magallanes
(74) *Attorney, Agent, or Firm* — Na Xu; IPro, PLLC

(57) ABSTRACT

An antenna system with a full metal back cover is provided in the present disclosure. The antenna system includes a metal back cover with a main body, a first sidewall and a second sidewall opposite to each other, a circuit board with a main ground point, a first antenna module and a second antenna module electrically connected to the circuit board. A first gap is formed between the first sidewall and the main body, and a second gap is formed between the second sidewall and the main body; the metal back cover is divided into a first metal portion including the first sidewall and a second metal portion including the second sidewall. The first metal portion includes a top slit penetrating through an edge of the first sidewall, and the second metal portion includes a bottom slit penetrating through an edge of the second sidewall.

13 Claims, 14 Drawing Sheets

ANTENNA SYSTEM WITH FULL METAL BACK COVER

FIELD OF THE DISCLOSURE

The present disclosure generally relates to mobile communication technologies, and more particularly, to an antenna system applicable to a mobile terminal.

BACKGROUND

With the development of mobile communication technologies, mobile terminals such as mobile phones, tablet computers, or the like, are used more and more widely. Mobile terminals normally use antenna systems to convert electric power into radio waves, and vice versa, for realizing wireless transmission and reception. One of important components in an antenna system is an antenna radiator (namely, a radiating part), which is typically arranged on an inner surface of a back cover of a mobile terminal.

Mobile terminals with metal shells, for example, metal back covers, are become more and more popular because of fashion appearance as well as good durability. However, the metal back cover may cause the radio waves be shielded from the radiating part of the antenna system, and thus a radiation efficiency of the antenna system is very low. As such, the antenna system is incapable of performing normal transmission and reception for wireless signals.

Therefore, it is necessary to provide a new antenna system which can overcome the aforesaid problems.

BRIEF DESCRIPTION OF THE DRAWINGS

Many aspects of the embodiments can be better understood with reference to the following drawings. The components in the drawing are not necessarily drawn to scale, the emphasis instead being placed upon clearly illustrating the principles of the present disclosure. Moreover, in the drawings, like reference numerals designate corresponding parts throughout the several views.

DETAILED DESCRIPTION

The present disclosure will be described in detail below with reference to the attached drawings and an embodiment thereof.

Figure 1:
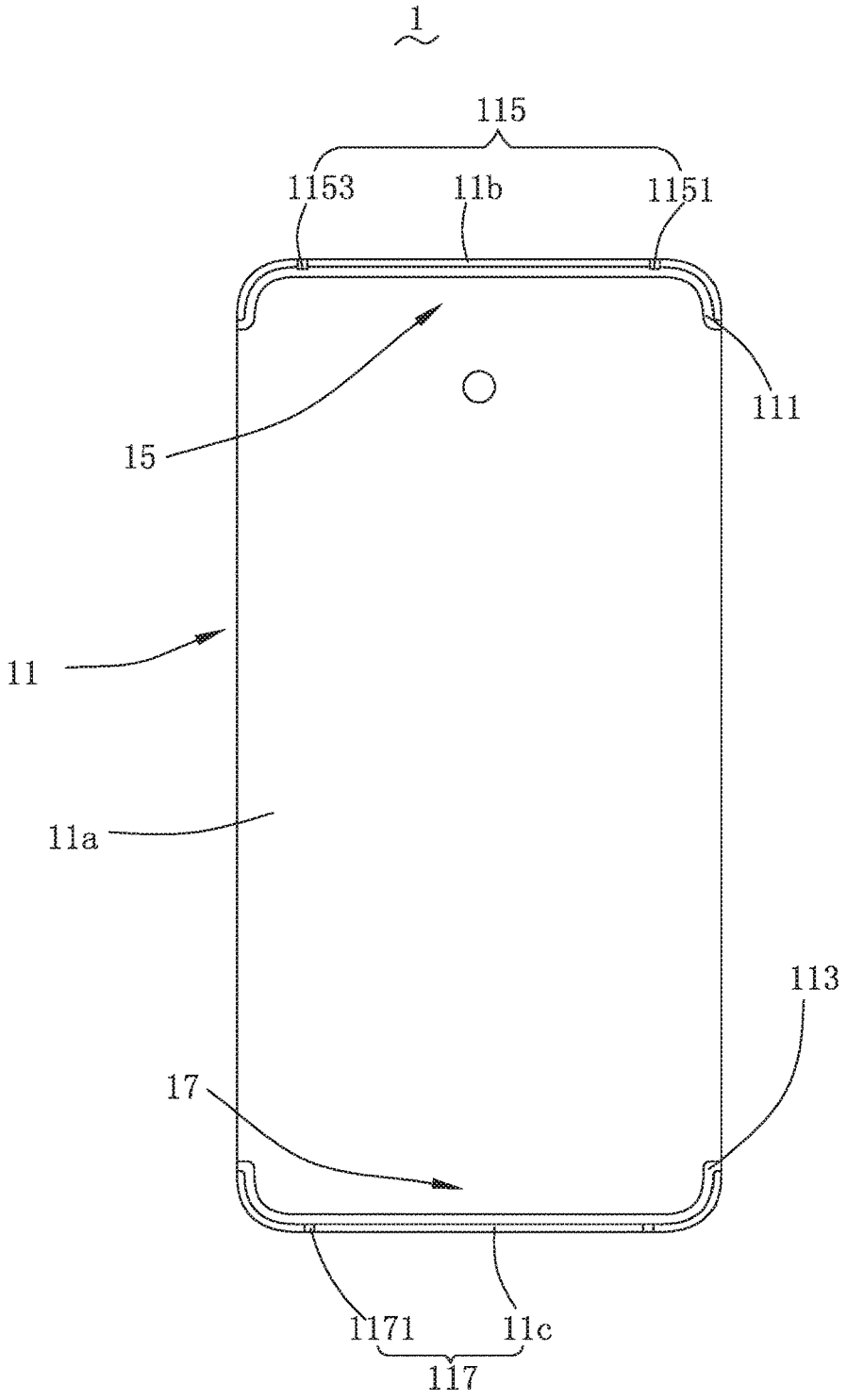
FIG. 1 is a schematic view of an antenna system with a full metal back cover according to an exemplary embodiment of the present disclosure.
Figure 2:
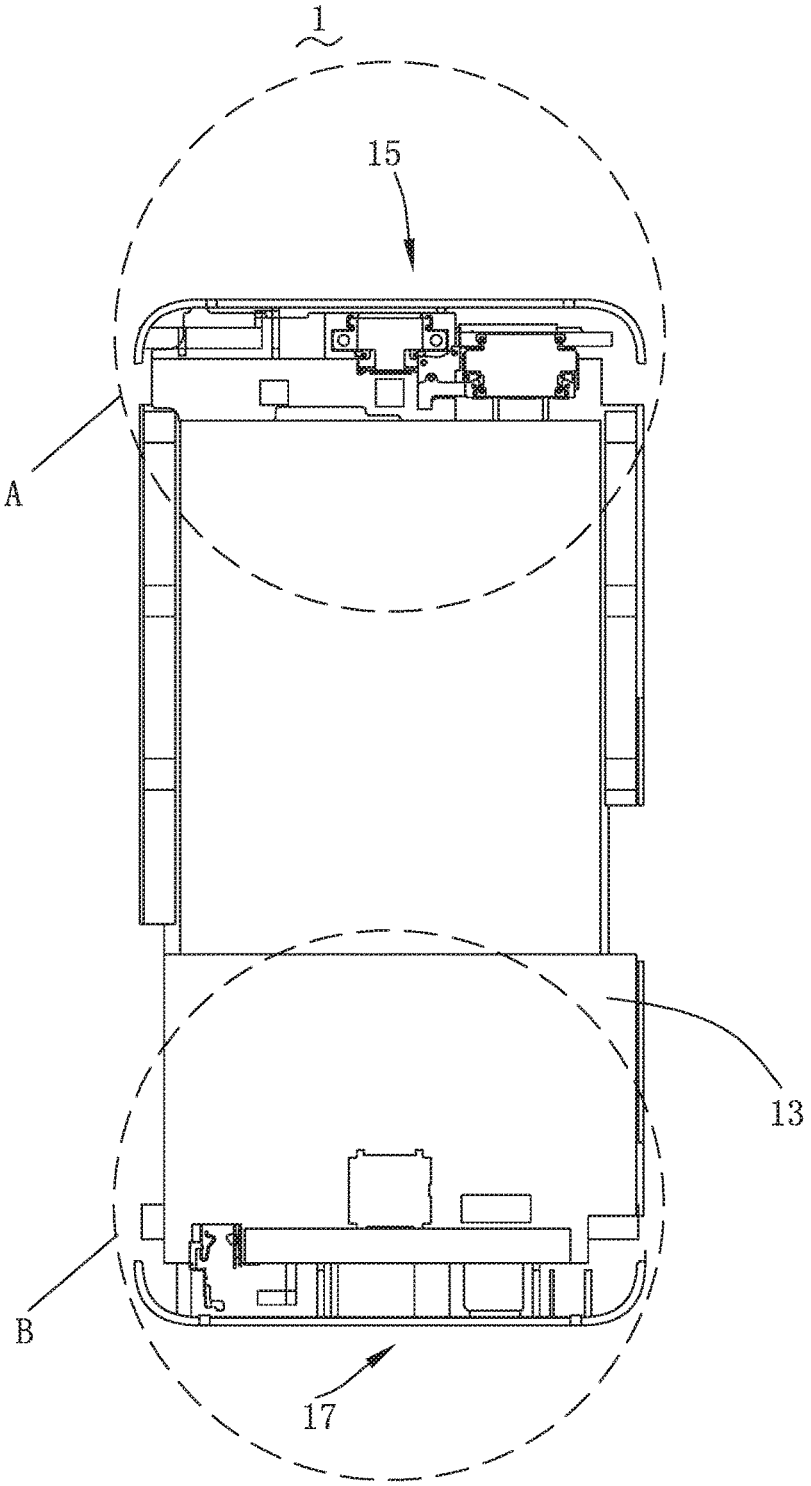
FIG. 2 is a partial view of the antenna system of FIG. 1.

Referring to FIG. 1 and FIG. 2, an antenna system 100 according to an embodiment of the present disclosure includes a metal back cover 11, a circuit board 13, a first antenna module 15 and a second antenna module 17. The first antenna module 15 is configured as a main antenna module in the antenna system 100, and the second antenna module 17 is configured as a secondary antenna module in the antenna system 100. Both of the first antenna module 15 and the second antenna module 17 are electrically connected to the circuit board 13.

Figure 3:
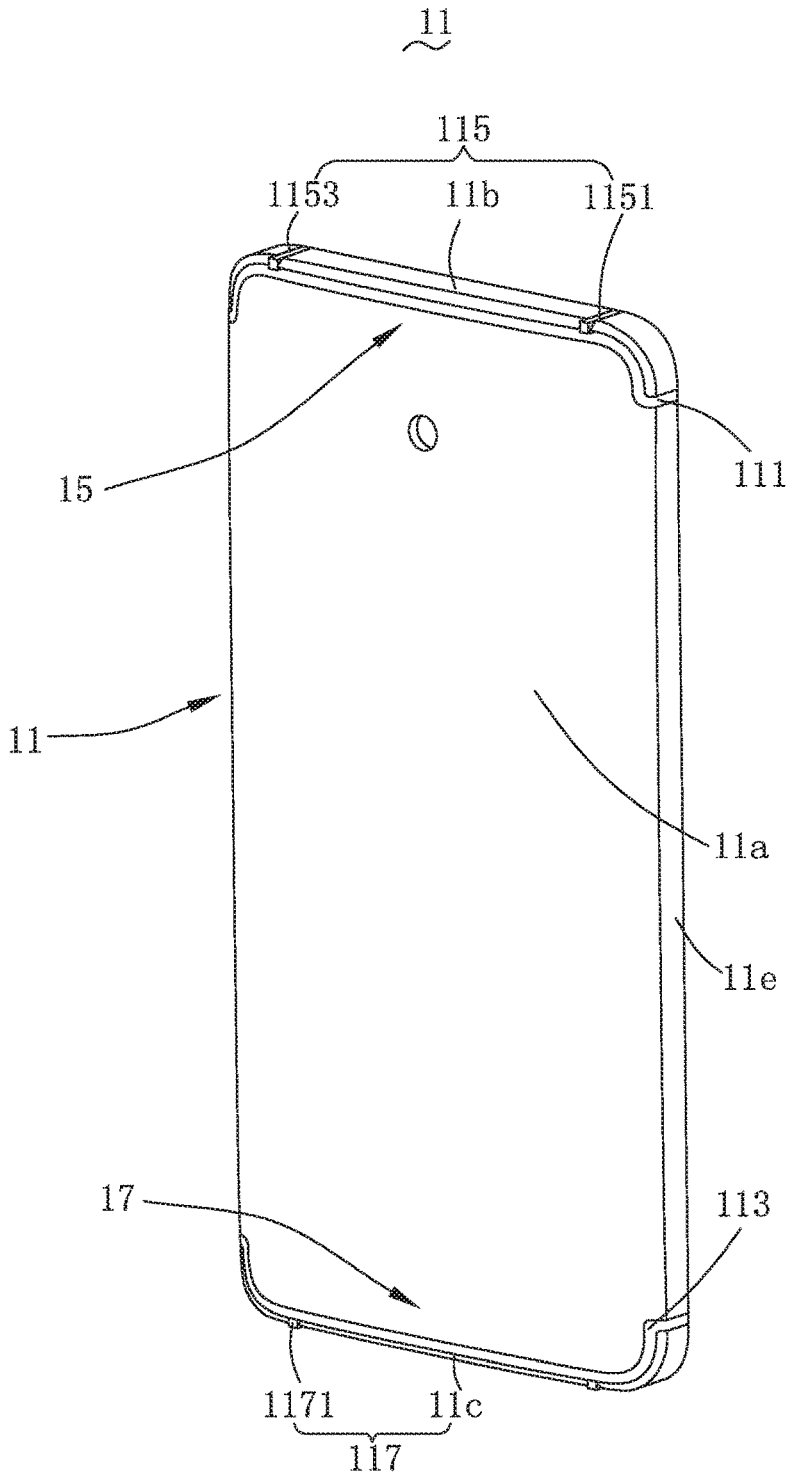
FIG. 3 is a schematic view of the metal back cover of the antenna system of FIG. 1 in a first view angle.
Figure 4:
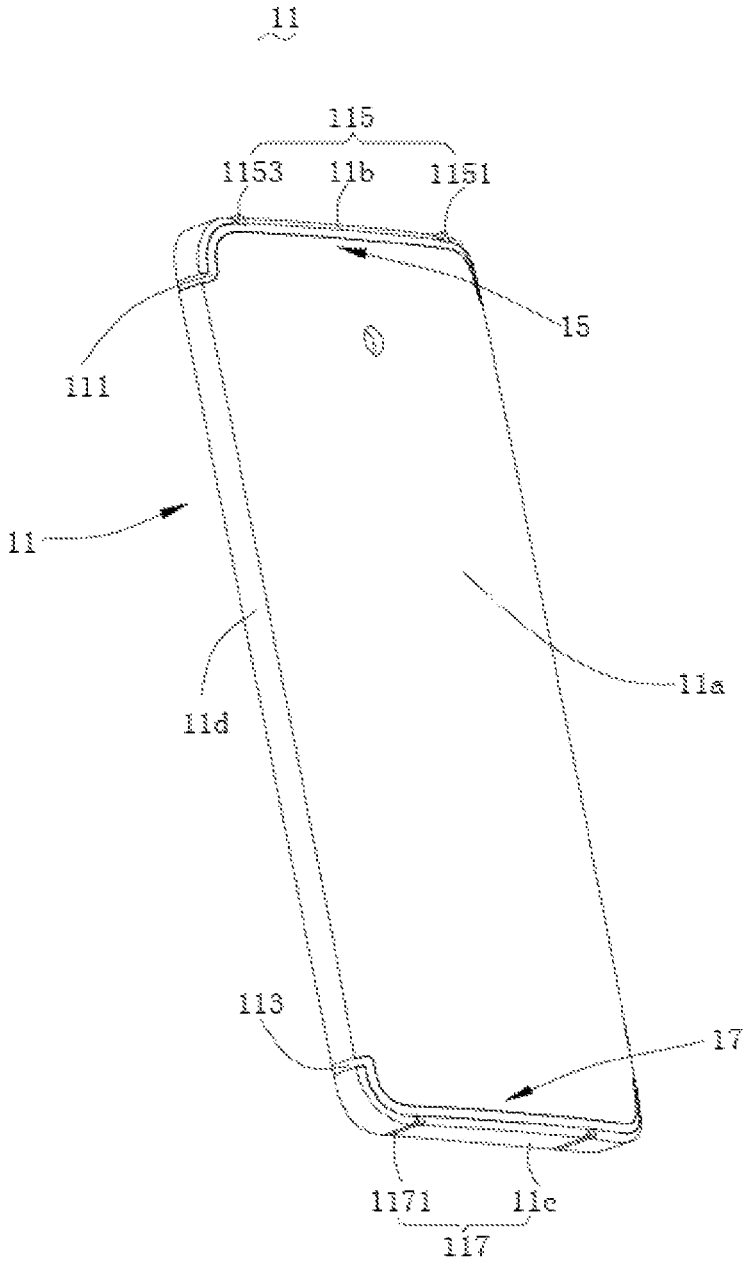
FIG. 4 is a schematic view of the metal back cover of the antenna system of FIG. 1 in a second view angle.

Referring also to FIGS. 3-4, the metal back cover 11 includes a main body 11*a*, a first sidewall 11*b*, a second sidewall 11*c*, a third sidewall 11*d* and a fourth sidewall 11*e*. The first sidewall 11*b*, the second sidewall 11*c*, the third sidewall 11*d* and the fourth sidewall 11*e* extend from the main body 11*a*, in such a manner that the first sidewall 11*b* and the second sidewall 11*c* are opposite to each other, and the third sidewall 11*d* and the fourth sidewall 11*e* are opposite to each other.

In addition, two gaps are formed in the metal back cover 11, that is, a first gap 111 and a second gap 113. The first gap 111 and the second gap 113 have a same configuration but are formed in different location of the metal back cover 11. In particular, the first gap 111 and the second gap 113 may have a same width of about 1.5 mm.

The first gap 111 is located at a joint area between the first sidewall 11*b* and the main body 11*a*; the second gap 113 is located at a joint area between the second sidewall 11*c* and the main body 11*a*. In addition, a first end of the first gap 111 extends to an end of the third sidewall 11*d* adjacent to the first sidewall 11*b*, and a second end of the first gap 111 extends to an end of the fourth sidewall 11*e* adjacent to the first sidewall 11*b*. Similarly, a first end of the second gap 113 extends to an end of the fourth sidewall 11*e* adjacent to the second sidewall 11*c*, and a second end of the second gap 113 extends to an end of the third sidewall 11*d* adjacent to the second sidewall 11*c*.

Due to the first gap 111 and the second gap 113, the metal back cover 11 is split up into a first metal portion 115 including the first sidewall 11*b*, a second metal portion 117 including the second sidewall 11*c*, and a third metal portion 119 between the first metal portion 115 and the second metal portion 117. The first metal portion 115, the second metal portion 117 and the third metal portion 119 are insulated from each other.

In the present embodiment, the first metal portion 115 and the second metal portion 117 respectively serves as a main antenna radiating portion and a secondary antenna radiating portion.

Figure 5:
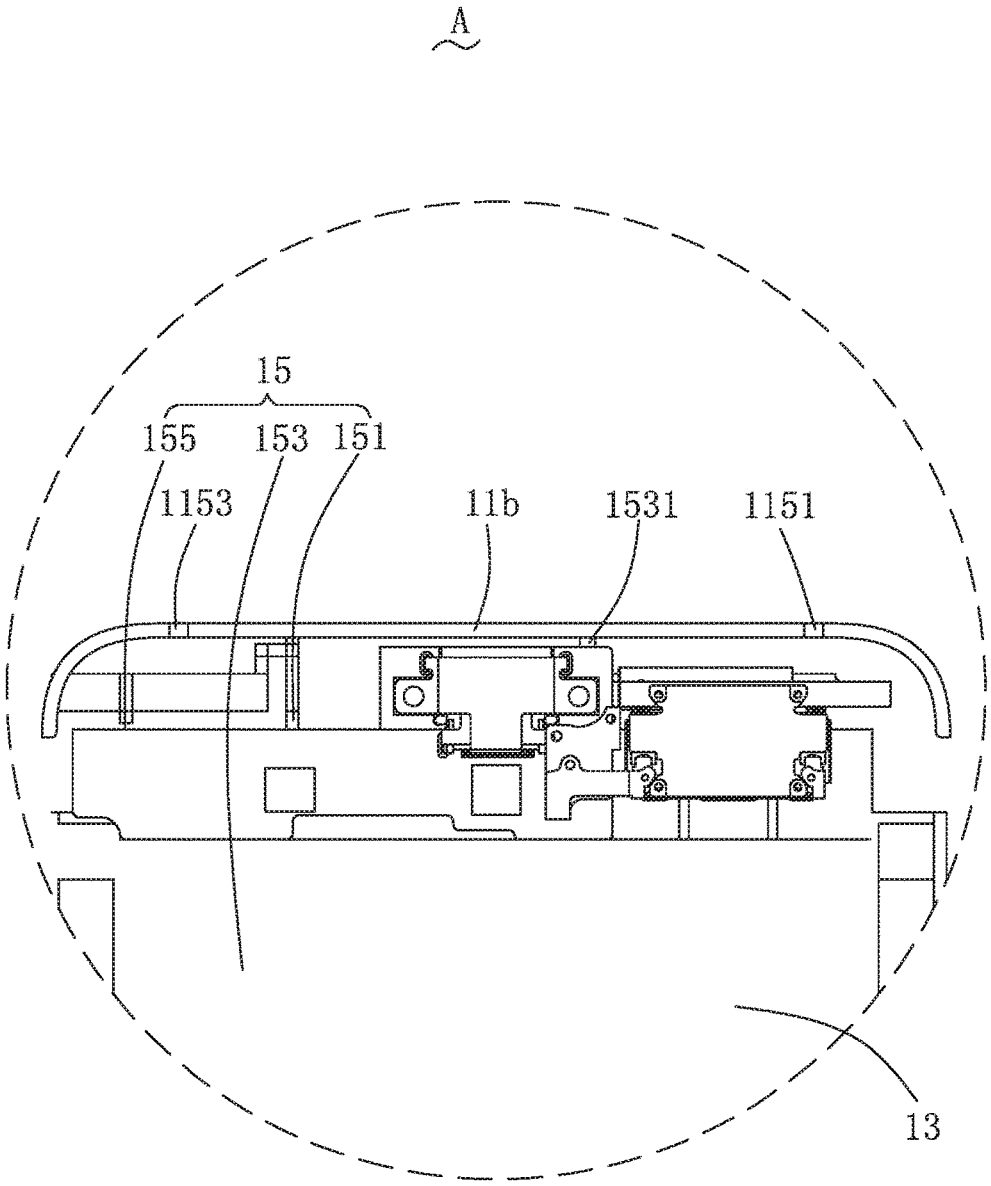
FIG. 5 is an enlarged view of an area A in the antenna system of FIG. 2.

Referring also to FIG. 5, the first portion 115 includes the first sidewall 11*b*, a top slit 1151 and a simulated slit 1153. The top slit 1151 may be formed adjacent to the third sidewall 11*d* or the fourth sidewall 11*e*, and in the present embodiment, the top slit 1151 is located adjacent to the fourth sidewall 11*e* while the simulated slit 1153 is located adjacent to the third sidewall 11*d*. Moreover, the top slit 1151 penetrates from an edge of the first sidewall 11*b* to the first gap 111 along a shortest path.

The simulated slit 1153 may be formed by an insulating coating layer, which is coated at a surface of the first sidewall 11*b*. The simulated slit 1153 is configured for ensuring the first metal portion 115 and the second metal portion 117 to have a uniform profile. Accordingly, the simulated slit 1153 does not physically cut off the first sidewall 11*b*, and thus have little influence on antenna signals.

The first antenna module 15 includes a main feed point 151, a match circuit 153 and a ground point 155. The match circuit 153 is disposed on the circuit board 13. The min feed point 151 is disposed at a location distant from the top slit 1151, and is electrically connected to the first metal portion 115.

Figure 6:
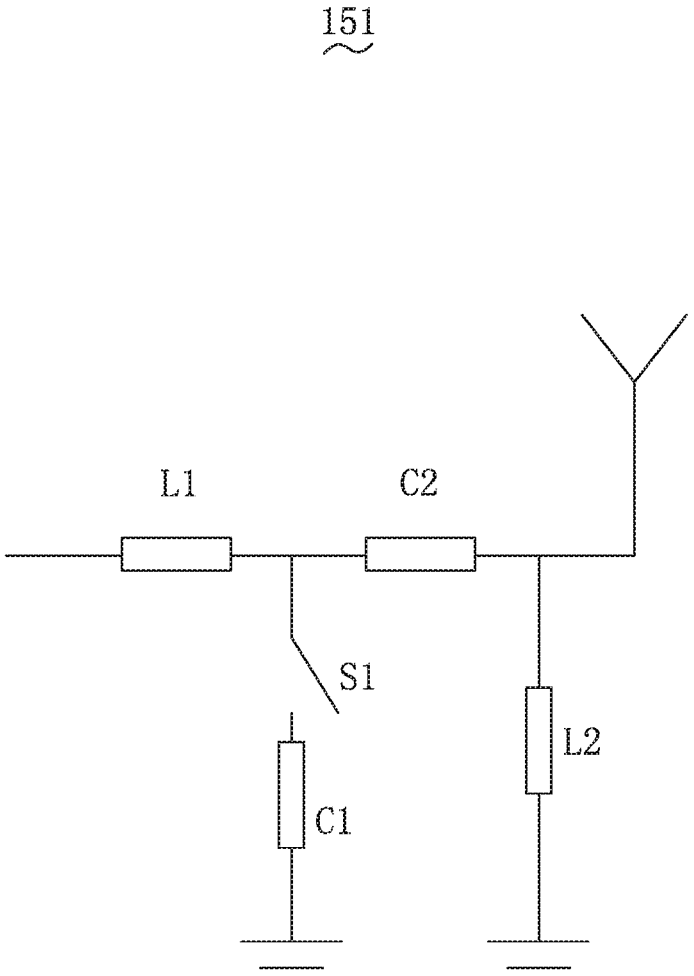
FIG. 6 is a circuit diagram of a match circuit of a first antenna module in the antenna system of FIG. 1.

Referring also to FIG. 6, the match circuit 153 includes a ground switch 1531, a capacitor switch S1, a first inductor L2, a second inductor L2, a first capacitor C1 and a second capacitor C2.

The ground switch 1531 is disposed between the top slit 1151 and the main feed point 151, and is configured for controlling whether the first metal portion 115 is grounded. The first capacitor C1 and the first inductor L1 are connected in parallel, the capacitor switch S1 and the first capacitor C1 are connected in series, and the capacitor switch S1 is configured for controlling an on/off state of the first capacitor C1. The second capacitor C2 and the first inductor L1 are connected in series; the second capacitor C2 and the second inductor L2 are connected in parallel.

In the present embodiment, only a single ground point 155 is formed in the first antenna module 15, the ground point 155 is more distant from the top slit 151 than the main feed point 151, and is also connected to the first metal portion 115.

The first antenna module 15 may be controlled to operate in three different working states by controlling on/off states of the capacitor switch S1 and the ground switch 1531, such that first antenna module 15 is capable of obtaining three different operation frequency bands respectively.

In a first working state, both the capacitor switch S1 and the ground switch 1531 are switched off. In this circumstance, the main feed point 151 or the ground point 155 is electrically connected to the first metal portion 115, and the first antenna module 15 operates in a first operation frequency band of GSM 900 and 2300 MHz to 2400 MHz.

In a second working state, both the capacitor switch S1 and the ground switch 1531 are switched on. In this circumstance, the main feed point 141 or the ground point 144 is electrically connected to the first metal portion 115, and the first antenna module 15 operates in a second operation frequency band of 1710 MHz to 2170 MHz and 2500 MHz to 2690 MHz.

In a third working state, the capacitor switch S1 is switched off. In this circumstance, the first antenna module 15 operates in a third operation frequency band of GSM850 and 2300 MHz to 2400 MHz.

Figure 8:
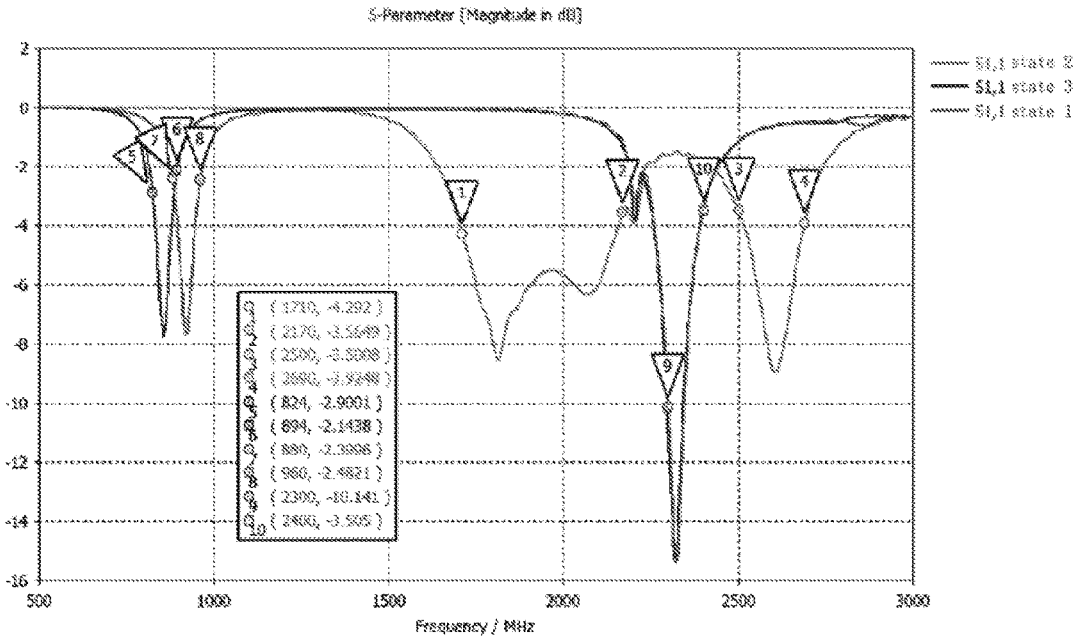
FIG. 8 illustrates frequency to gain relation curves of the first antenna module in the antenna system of FIG. 1 in three working states.

Referring also to FIG. 8, frequency to gain relation curves of the first antenna module 15 in the antenna system 1 in the above-described three working states are shown. From the frequency to gain relation curves, it can be found that the first antenna module 15 can obtain good performance when operates in all the three working states.

Figure 9:
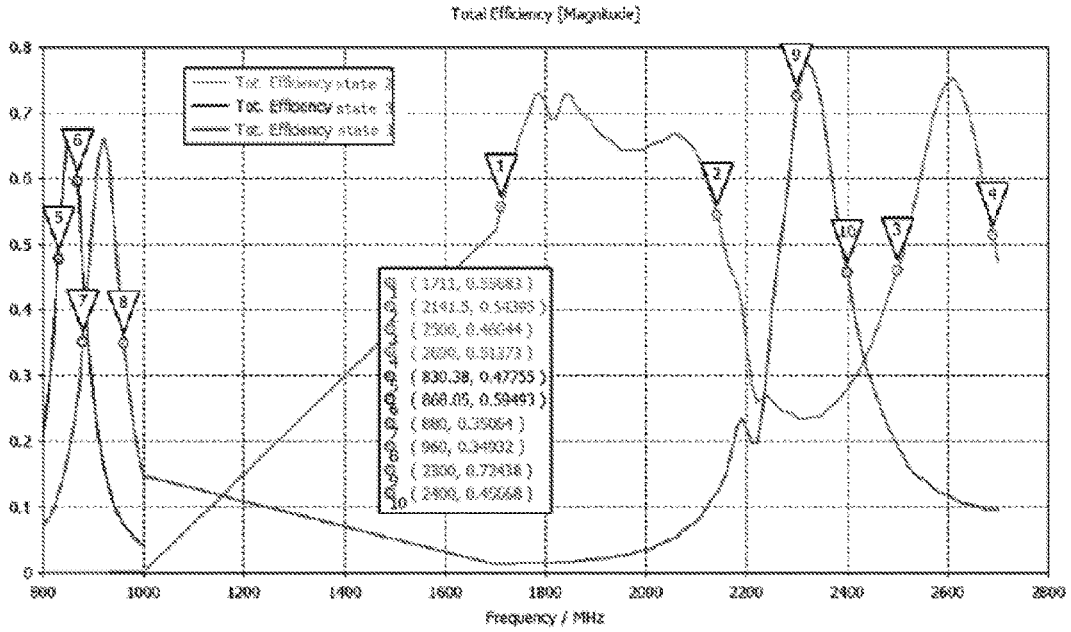
FIG. 9 illustrates frequency to efficiency relation curves of the first antenna module in the antenna system of FIG. 1 in three working states.

FIG. 9 illustrates frequency to efficiency relation curves of the first antenna module 15 in the antenna system 1 in above-described three working states. From the frequency to efficiency relation curves, it can be found that an average antenna efficiency of the first antenna module 15 in each of the above-described three working states is as follows.

When operating in GSM 850, an average antenna efficiency of the first antenna module 15 is 51.9%.

When operating in GSM 900, an average antenna efficiency of the first antenna module 15 is 51.2%.

When operating in the frequency band from 1710 MHz to 2170 MHz, an average antenna efficiency of the first antenna module 15 is 64.9%.

When operating in the frequency band from 2300 MHz to 2400 MHz, an average antenna efficiency of the first antenna module 15 is 65.9%.

When operating in the frequency band from 2500 MHz to 2690 MHz, an average antenna efficiency of the first antenna module 15 is 63.3%.

From the average antenna efficiencies as described above, it can also be found that the first antenna module 15 is capable of obtaining good antenna efficiency.

Figure 7:
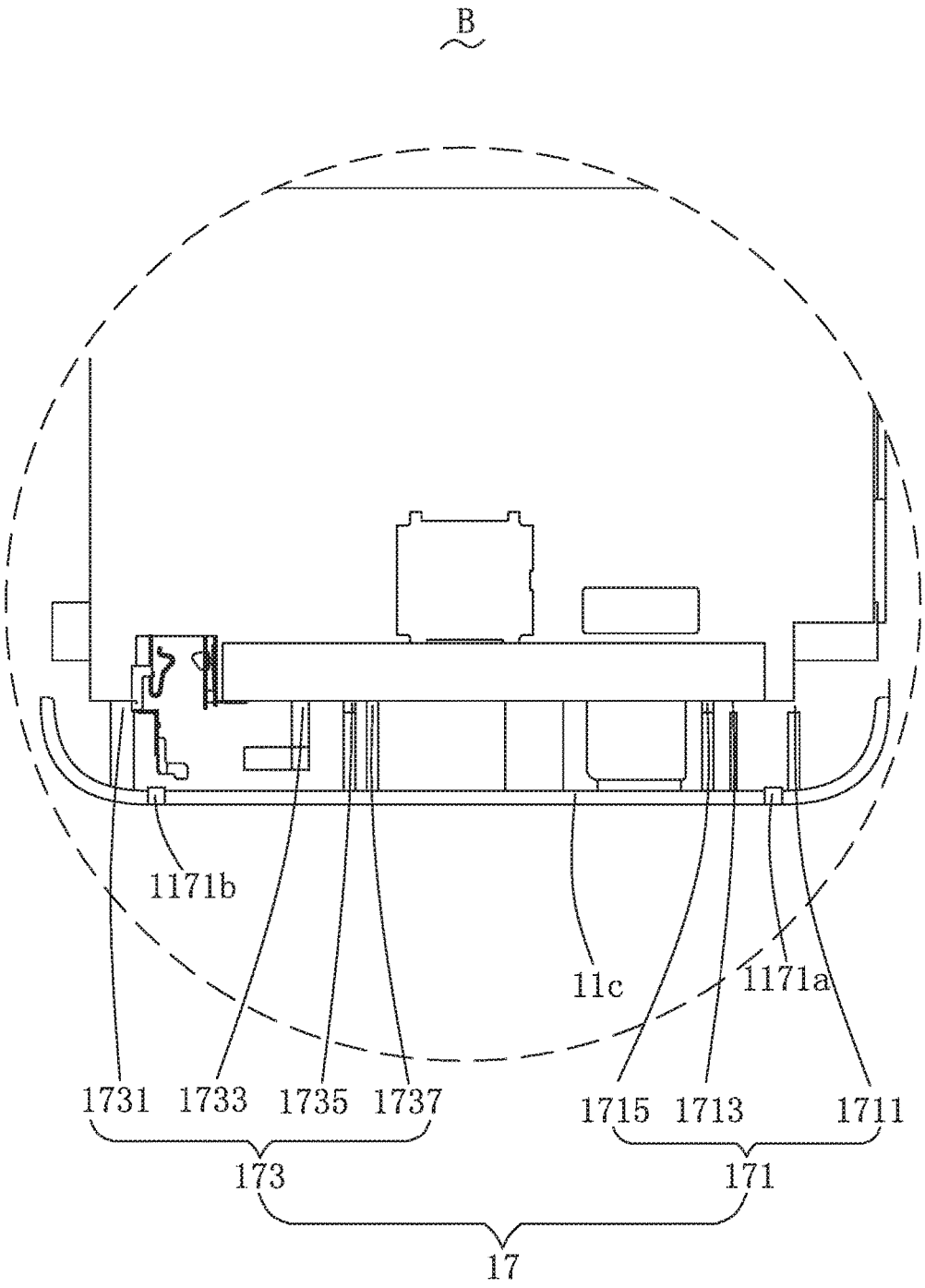
FIG. 7 is an enlarged view of an area B in the antenna system of FIG. 2.

Referring also to FIG. 7, the second metal portion 117 includes the second sidewall 11*c* and at least one bottom slit 1171. The bottom slit 1171 penetrates from an edge of the second sidewall 11*c* to the second gap 113 along a shortest path. In the present embodiment, two bottom slits 1171 apart from each other are provided in the second metal portion 117. In the following description, the two bottom slits 1171 are respectively named as a first bottom slit 1171*a* adjacent to the fourth sidewall 11*e*, and a second bottom slit 1171*b* adjacent to the three sidewall 11*d*. The first bottom slit 1171*a* and the second bottom slit 1171*b* have a same configuration but are formed at different locations. The first bottom slit 1171*a* and the second bottom slit 1171*b* correspond to the top slit 1151 and the simulated slit 1171 respectively, and accordingly, the antenna system 1 with the full metal cover 11 have appearance with good integrity The second antenna module 17 may include one or more antenna unit; in the present embodiment, two antenna units is included in the second antenna module 1, namely, a diversity antenna unit 171 and a GPS/WIFI antenna unit 173.

The diversity antenna unit 171 includes at least one ground point 1711 and a feed point 1713. When a plurality of ground points 1711 is included in the diversity antenna unit 171, the diversity antenna unit 171 is enabled to have multiple operation frequency bands. In the present embodiment, only one ground point 1711 is arranged in the diversity antenna unit 171. The ground point 1711 and the feed point 1713 are respectively located at two opposite sides of the first bottom slit 1171*a*, which is adjacent to the feed point 1713, and are electrically connected to the second metal portion 117.

The GPS/WIFI antenna unit 171 includes at least one ground point 1731, a parasitic antenna 1733 and a feed point 1735. The at least one ground point 1731 may also be configured to enable to GPS/WIFI antenna unit 171 to have multiple operation frequency bands. In the present embodiment, only one ground point 1731 is arranged in the GPS/WIFI antenna unit 173. The ground point 1731 and the feed point 1735 are respectively located at two opposite sides of the second bottom slit 1171*b*, which is adjacent to the feed point 1735, and are electrically connected to the second metal portion 117. The parasitic antenna 1733 has an L-shaped profile with an end being grounded, and is located between the feed point 1735 and the ground point 1731.

Moreover, a plurality of grounding units 1737 are arranged between the feed point 1713 of the diversity antenna unit 171 and the feed point 1735 of the GPS/WIFI antenna unit 173. In the present embodiment, two grounding units 1737 are arranged between the feed point 1713 of the diversity antenna unit 171 and the feed point 1735 of the GPS/WIFI antenna unit 173. Each of the grounding units 1737 may be a conductor for electrically connecting the second metal portion 117 and a main ground point of the circuit board 13. The grounding units 1737 is configured for enhancing isolation between the diversity antenna unit 171 and the GPS/WIFI antenna unit 173, so as to decrease signal interference between the diversity antenna unit 171 and the GPS/WIFI antenna unit 173. It should be noted that the number of the grounding units is not limited to two, for example, only one grounding unit or more that two grounding units are also suitable in the antenna system as provided the present disclosure.

The diversity antenna unit 171 has a first operation frequency of 1880 MHz, and a second operation frequency of 2600 MHz. The first operation frequency of 1880 MHz is provided by the parasitic antenna 1733, and the second operation frequency of 2600 MHz is provided by a planar inverted-F antenna (PIFA).

Figure 10:
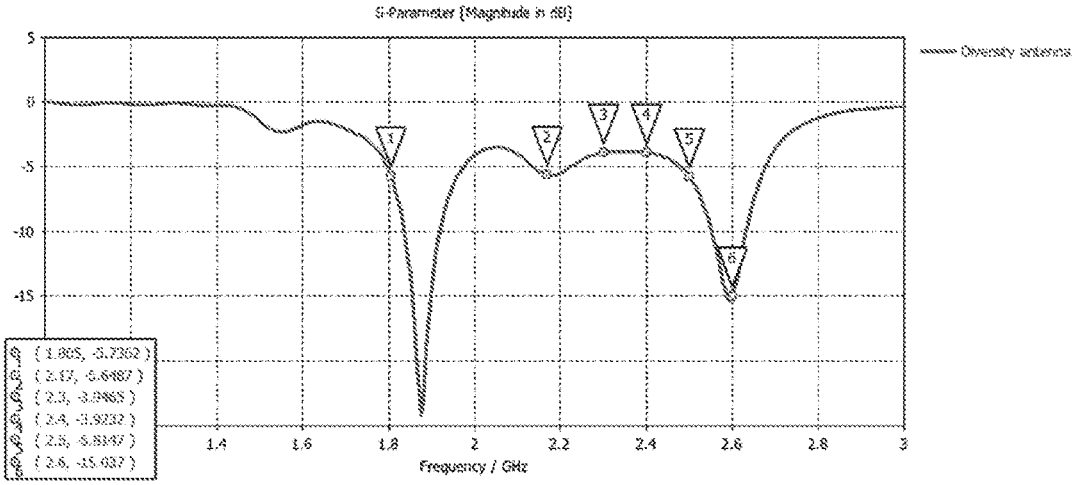
FIG. 10 illustrates a frequency to gain relation curve of a diversity antenna unit of a second antenna module in the antenna system of FIG. 1.
Figure 11:
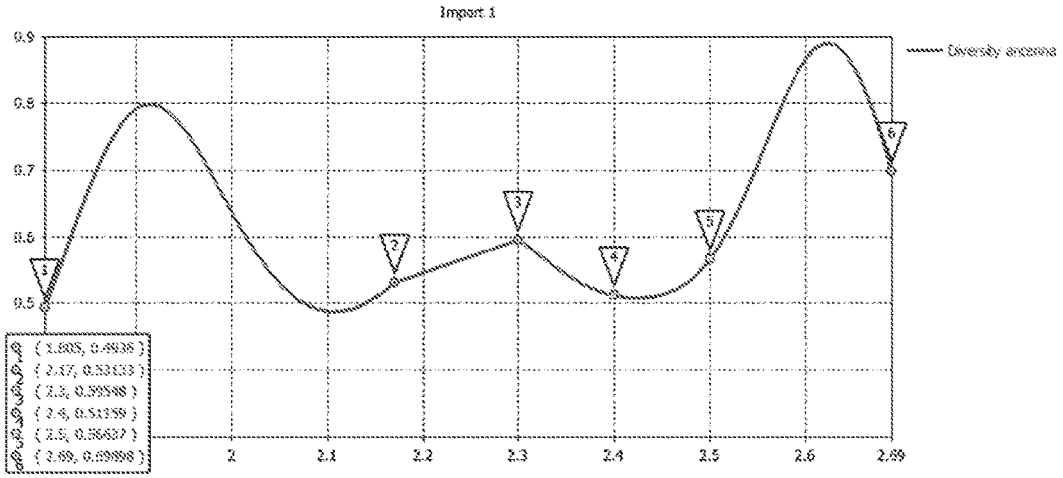
FIG. 11 illustrates a frequency to efficiency relation curve of the diversity antenna unit of the second antenna module in the antenna system of FIG. 1.

FIG. 10 and FIG. 11 illustrate a frequency to gain relation curve and a frequency to efficiency relation curve of the diversity antenna unit 171 of the second antenna module 17. As illustrated in FIG. 10 and FIG. 11, the diversity antenna unit 171 can obtain good antenna gain and antenna efficiency.

The GPS/WIFI antenna unit 173 can have four operation frequencies by adjusting capacitance and inductance thereof. The four operation frequencies includes a first operation frequency of 1560 MHz provided by a PIFA, a second operation frequency of 2440 MHz provided by a parasitic antenna, a third operation frequency of 5550 MHz provided by a high-order PIFA, and a fourth operation frequency of 5820 provided by the parasitic antenna 1733.

Figure 12:
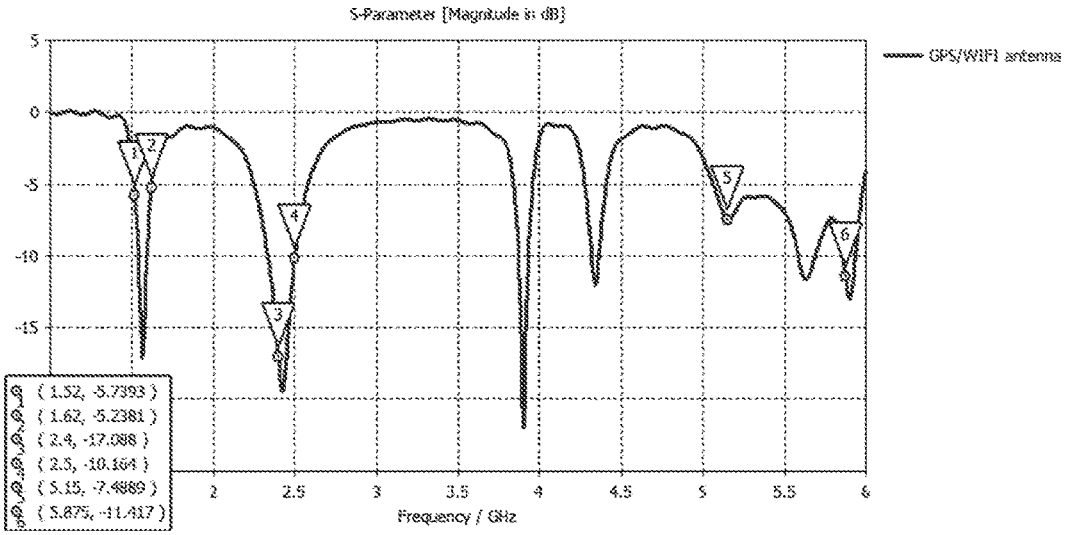
FIG. 12 illustrates a frequency to gain relation curve of a GPS/WIFI antenna unit of the second antenna module in the antenna system of FIG. 1.
Figure 13:
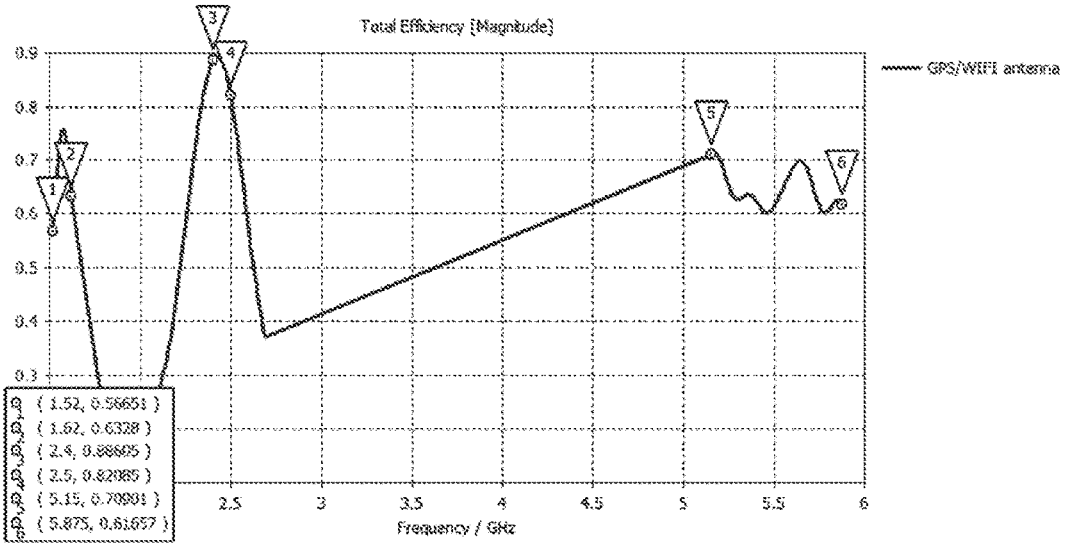
FIG. 13 illustrates a frequency to efficiency relation curve of the GPS/WIFI antenna unit of the second antenna module in the antenna system of FIG. 1.

FIG. 12 and FIG. 13 illustrate a frequency to gain relation curve and a frequency to efficiency relation curve of the GPS/WIFI antenna unit 173 of the second antenna module 17. As illustrated in FIG. 12 and FIG. 13, the GPS/WIFI antenna unit 173 can also obtain good antenna gain and antenna efficiency.

Figure 14:
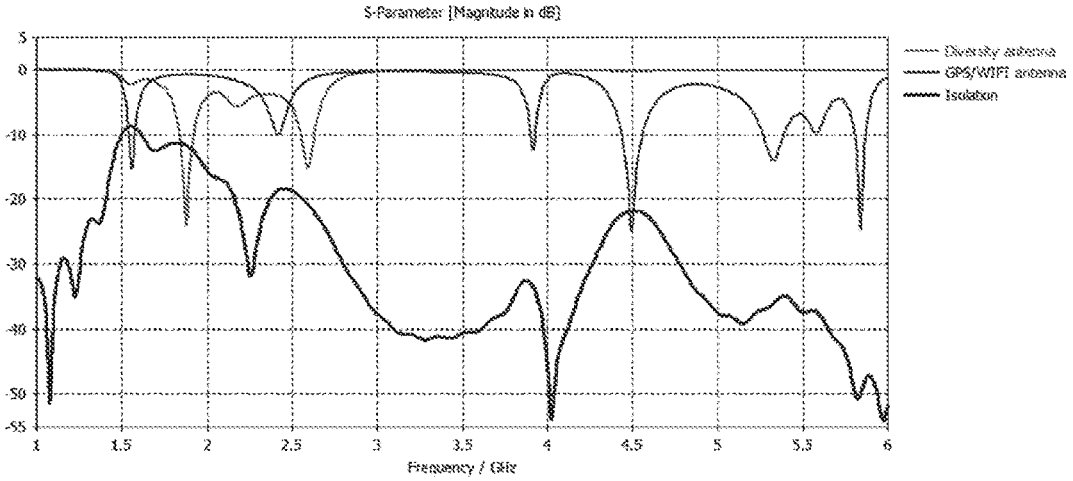
FIG. 14 illustrates an isolation curve of the diversity antenna unit and the GPS/WIFI antenna unit of the second antenna module in the antenna system of FIG. 1.

Referring also to FIG. 14, an isolation curve of the diversity antenna unit 171 and the GPS/WIFI antenna unit 173 of the second antenna module 17 is shown. The diversity antenna unit 171 and the GPS/WIFI antenna unit 173 share the second metal portion 117 as a radiating portion, and as illustrated in FIG. 14, the diversity antenna unit 171 and the GPS/WIFI antenna unit 173 have good isolation in most of frequency bands, and can also obtain good radiating effect.

In the antenna system 1 with full metal cover as provided in the present disclosure, the first gap 111 is located between the first sidewall 11*b* and the main body 11*a*, and the second gap 113 is located between the second sidewall 11*c* and the main body 11*a*; with this configuration, the metal back cover 11 is separated into a first metal portion 115 serving as a radiating portion of the first antenna module 15 and a second metal portion 117 serving as a radiating portion of the second antenna module 17. As such, radiation performance of the antenna system 1 can be ensured to perform wireless transmission and reception; moreover, an integrity of the metal back cover 11 can be maintain, and thus a mobile terminal using the antenna system 1 has a good appearance.

It is to be understood, however, that even though numerous characteristics and advantages of the present embodiment have been set forth in the foregoing description, together with details of the structures and functions of the embodiment, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An antenna system, comprising:

a metal back cover comprising a main body and a plurality of sidewalls extending from the main body, the plurality of sidewalls comprising a first sidewall and a second sidewall opposite to each other;

a circuit board with a main ground point;

a first antenna module and a second antenna module electrically connected to the circuit board;

wherein a first gap is formed between the first sidewall and the main body, and a second gap is formed between the second sidewall and the main body; By the first gap and the second gap, the metal back cover is divided into a first metal portion including the first sidewall, a second metal portion including the second sidewall, and a third metal portion between the first metal portion and the second metal portion, which are insulated from each other;

wherein the first metal portion comprises a top slit penetrating through an edge of the first sidewall and the first gap, and the second metal portion comprises at least one bottom slit penetrating through an edge of the second sidewall and the second gap;

the second antenna module comprises a diversity antenna unit;

two bottom slits are formed in the second metal portion, the diversity antenna unit comprises a first feed point;

the diversity antenna unit comprises a first ground point, the first feed point and the first ground point of the diversity antenna unit are respectively connected to the second metal portion at locations at two opposite sides of a bottom slit adjacent to the first feed point.

2. The antenna system of claim 1, wherein the first antenna module and the second antenna module are configured as a main antenna module and a secondary antenna module respectively.

3. The antenna system of claim 1, wherein the first antenna module comprises a match circuit on the circuit board, a main feed point electrically connected to the first metal portion, and at least one ground point electrically connected to the main ground point on the circuit board.

4. The antenna system of claim 3, wherein the second antenna module comprises a feed point on the circuit board and electrically connected to the second metal portion, and at least one ground point electrically connected to the main ground point on the circuit board.

5. The antenna system of claim 3, wherein the metal back cover further comprises a third sidewall and a fourth sidewall opposite to each other; the top slit is located adjacent to the third sidewall or the fourth sidewall, and the main feed point is connected to the first metal portion at a distant location from the top slit.

6. The antenna system of claim 5, wherein the match circuit comprises a first inductor, a first capacitor connected to the first inductor in parallel, a capacitor switch connected to the first capacitor in series, a second capacitor connected to the first inductor in parallel, a second inductor connected to the first inductor in parallel, and a ground switch between the top slit and the main feed point and for controlling whether the first metal portion is grounded.

7. The antenna system of claim 5, wherein the first antenna module comprises a single ground point connected to the first metal portion at a more distant location from the top silt than the main feed point.

8. The antenna system of claim 4, wherein the second antenna module comprises a GPS/WIFI antenna unit.

9. The antenna system of claim 8, wherein the GPS/WIFI antenna unit comprises a second feed point; the first feed point and the second feed point are arranged between the two bottom slits.

10. The antenna system of claim 9, wherein a plurality of grounding units electrically connected to the main ground point and between the first feed point and the second feed point.

11. The antenna system of claim 9, wherein the GPS/WIFI antenna unit comprises a second ground point, the second feed point and the second ground point of the GPS/WIFI antenna unit are respectively connected to the second metal portion at locations at two opposite sides of a bottom slit adjacent to the second feed point.

12. The antenna system of claim 11, wherein the GPS/WIFI antenna unit further comprises a parasitic antenna between the second feed point and the second ground point of the GPS/WIFI antenna.

13. The antenna system of claim 12, wherein the parasitic antenna is an L-shaped antenna with an end being grounded.

* * * * *